US006739989B2

(12) United States Patent
Liberatore

(10) Patent No.: US 6,739,989 B2
(45) **Date of Patent: *May 25, 2004**

(54) WEIGHT HOLDER ATTACHABLE TO ATHLETIC BALL STRIKER

(76) Inventor: Raymond A Liberatore, 12143 Punkin Hollow Rd., Bentonville, AK (US) 72712

( * ) Notice: Subject to any disclaimer, the term of this patent is extended or adjusted under 35 U.S.C. 154(b) by 0 days.

This patent is subject to a terminal disclaimer.

(21) Appl. No.: 10/159,826

(22) Filed: May 29, 2002

(65) Prior Publication Data

US 2003/0224883 A1 Dec. 4, 2003

(51) Int. Cl.[7] ..... A63B 69/00

(52) U.S. Cl. ..... 473/457; 150/163; 273/DIG. 30; 473/422

(58) Field of Search ..... 473/457, 564, 473/404, 437, 567, 568, 520, 422; 463/47.1–47.7; 482/109; 150/163; 273/DIG. 30

(56) References Cited

U.S. PATENT DOCUMENTS

| | | | | |
|---|---|---|---|---|
| 2,676,803 A | | 4/1954 | Damaske | |
| 2,737,394 A | * | 3/1956 | Abel | 473/256 |
| 3,521,883 A | | 7/1970 | Hamilton | |
| 3,593,769 A | | 7/1971 | Spears | |
| 3,623,724 A | | 11/1971 | Lande | |
| 4,000,893 A | | 1/1977 | Evans | |
| 4,588,191 A | | 5/1986 | Stewart | |
| 4,671,510 A | * | 6/1987 | Schoenwetter | 473/437 |
| 4,842,280 A | | 6/1989 | Hilton | |
| 5,050,877 A | | 9/1991 | Wales | |
| 5,403,009 A | * | 4/1995 | Gleason, Jr. | 473/256 |
| 5,484,156 A | | 1/1996 | Giguerre | |
| 5,980,397 A | | 11/1999 | Hart et al. | |
| 6,010,415 A | | 1/2000 | Miggins | |
| 6,093,114 A | | 7/2000 | Haringa | |
| 6,102,810 A | | 8/2000 | Boland | |
| 6,443,851 B1 | * | 9/2002 | Liberatore | 473/256 |
| 6,461,249 B2 | * | 10/2002 | Liberatore | 473/256 |

* cited by examiner

*Primary Examiner*—Gregory Vidovich
*Assistant Examiner*—M. Chambers
(74) *Attorney, Agent, or Firm*—William W. Haefliger

(57) ABSTRACT

A weighting device for use on an athletic ball striker as during handle swinging of the striker comprising a receptacle having an opening via which the ball striking portion is received into the receptacle, with the handle projecting from the receptacle, a retainer carried on the receptacle to be fastened in a position for retaining the receptacle in generally enclosing relation to the ball striking portion, and weighting structure carried by the receptacle to add substantial weight to the striker for use as in striker practice swinging, the retainer including a foldable flap that retains the receptacle to the striker during such practice swinging, the striking may for example comprise a baseball bat, or a tennis racket.

21 Claims, 6 Drawing Sheets

14
18b
100d
35a
36
35
18a
36a
11e
40
37
37a 41
19
18a
100d
18b

WEIGHT HOLDER ATTACHABLE TO ATHLETIC BALL STRIKER

BACKGROUND OF THE INVENTION

This invention relates generally to swinging of ball strikers, as for example baseball bats, tennis rackets, and racket ball rackets and more particularly concerns removably adding weight to a ball striker, for practice swinging purposes.

When baseball players warm-up, or train, they commonly use two bats, and swing them in unison a few times to loosen muscles. Also used are a heavy bat or weighted rings. Holding and swinging two bats is awkward, uncomfortable, and does not achieve the right feel, needed as by gripping and swinging only one bat but one bat does not achieve additional weight as can be provided by two bats. Use of a heavy bat, and/or weighted rings is also disadvantageous. There is need to overcome this dilemma, in a simple, effective and efficient manner, as is now provided by the present invention. In a similar manner, there is need to provide additional weight to other ball strikers, such as tennis rackets, for example. Other strikers include racket ball rackets, cricket paddles, hockey sticks and table tennis paddles.

SUMARY OF THE INVENTION

It is a major object of the invention to provide a simple and effective weighting device meeting the above need. Basically, the device comprises:

a) an elongated receptacle having an opening via which the striker ball striking portion is received into the receptacle, with the handle projecting from the receptacle, b) a retainer carried on the receptacle to be fastened in a position for retaining the receptacle in generally enclosing relation to the striker ball striking portion, c) and weighting structure carried by the receptacle to add substantial weight to the striker, for use as in striker practice swinging, d) the retainer including a flap that folds over and releasably attaches to a surface carried by the receptacle, to effect retention of the weighted receptacle to the striker during the practice swinging.

As will be seen, the retainer flap or strap preferably is carried to extend at least part way along or about the receptacle, when closed on the ball striker, and hook and pile fastening material such as VELCRO may be provided to adhere the flap or strap in fastening position. Such closure preferably at least partly covers the opening in the receptacle that passes the ball striking portion of the striker, to prevent release or separation of the weighted receptacle during swinging.

Another object includes provision of a receptacle having multiple wall portions, and the weighting structure is preferably located at or proximate at least one of such wall portions.

In addition, the weighting structure typically includes metallic material, solid or flowable; it is typically concealed by the receptacle, and it may include separate localized metallic zones or portions. It may be sewn or otherwise held in a pocket or pockets provided by the receptacle, and at the end or at a side or sides of a ball striking portion of the striker retained in the receptacle.

Yet another object includes location of the weighting material in a pocket provided by the receptacle, and in this regard the pocket or pockets may enable selective use of the material in one or more pockets, for adjustable weighting, as to positioning, or as to selected weighting; or both. The pocket or pockets may be sized to fit different strikers or all sizes of strikers.

These and other objects and advantages of the invention, as well as the details of an illustrative embodiment, will be more fully understood from the following specification and drawings, in which:

DRAWING DESCRIPTION

DETAILED DESCRIPTION

Figure 1:
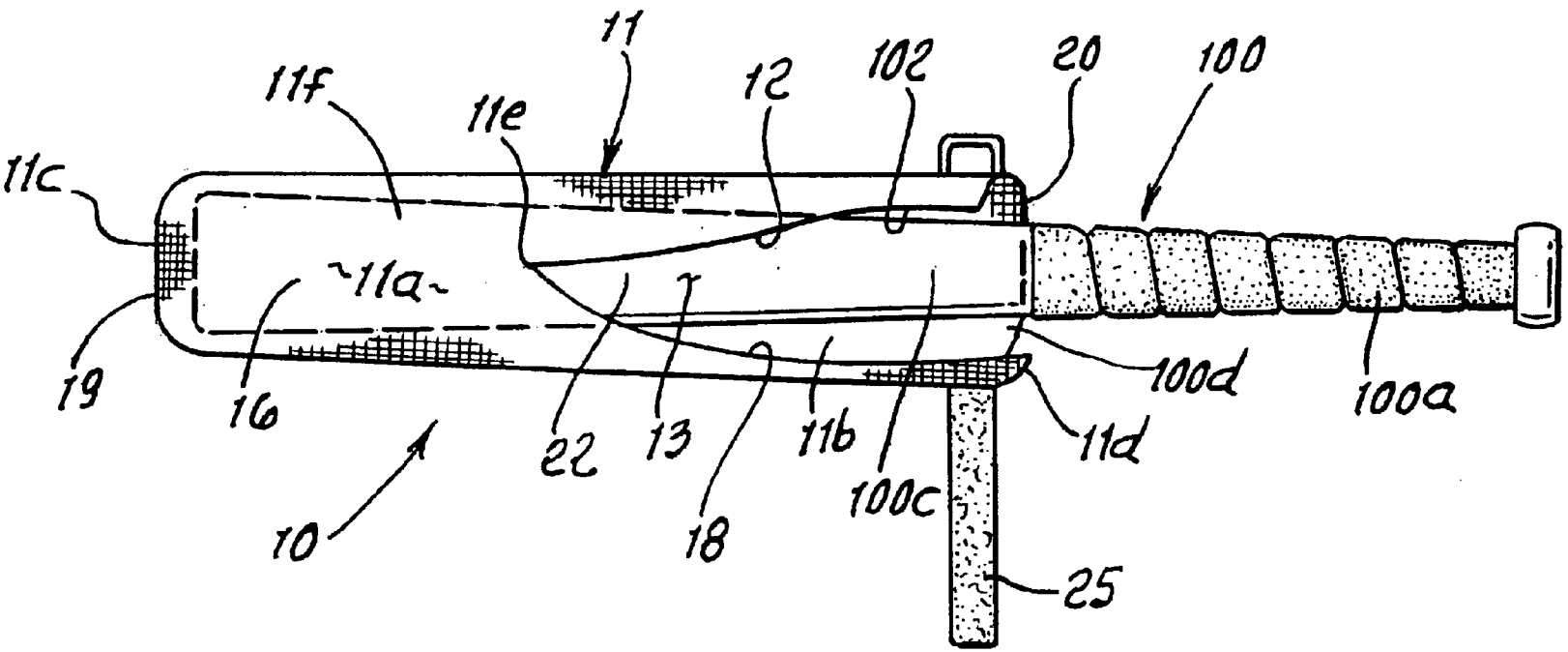
FIG. 1 is a side elevation showing a receptacle receiving the ball striking portion of a striker such as a baseball bat, with a retainer positioned to be wrapped along or over a side of the receptacle.

Referring to FIGS. 1–5, a weight holder device is shown at 10, for use on a ball striker such as a baseball bat 100 as during warm-up swinging of the bat. It includes a receptacle 11 having an elongated opening or split 12 via which, or through which, a ball striking portion 13 of the striker is received. Portion 13 may also be referred to herein as a "head". The receptacle has a front side 11*a,* a rear side 11*b,* a distal end 11*c,* and a proximal end at 11*d.* In this example, the opening 12 extends from the proximal end lid to a convergence lie in the front side 11*a,* and may have a long dimension indicated at 14 in FIG. 2. That dimension is typically sufficient to allow entry of the head 13 endwise, sidewise through the opening, and endwise into the receptacle forward sleeve portion 11*f,* as well as easy removal from the receptacle. The receptacle typically consists of flexible fabric or other material which is tough and durable, as for example synthetic resinous (plastic) material.

The elongated receptacle preferably has wall portions, and typically at least two of the following:

i) an elongated front side or first wall portion 16 to extend adjacent, or proximate a side of the head 13 of the bat 100;

ii) a rear side or second inner wall portion to extend adjacent or proximate the head rear side;

iii) a forward or third wall portion 19 to extend forwardly of or adjacent the distal end of the bat head;

iv) a rearward or fourth wall portion 20 at the proximal end of the receptacle, and at the narrowed end 100*c* of the bat, near handle 100*a* of the bat.

The receptacle further defines a interior cavity or slot 22 receiving the head, and wall 16 is slit as at 18, along part of the receptacle length, the slit intersecting proximal end 11*d.* Proximal end opening 100*d* of the receptacle intersects the slit 18 to form an enlarged opening 102, for ease of bat reception. The narrowed portion 100*c* of the bat "lays into" opening 100*d*.

As will be seen, a retainer is carried on the receptacle to extend and to be fastened in a position for retaining the receptacle in close fitting relation to the bat shank.

Figure 4:
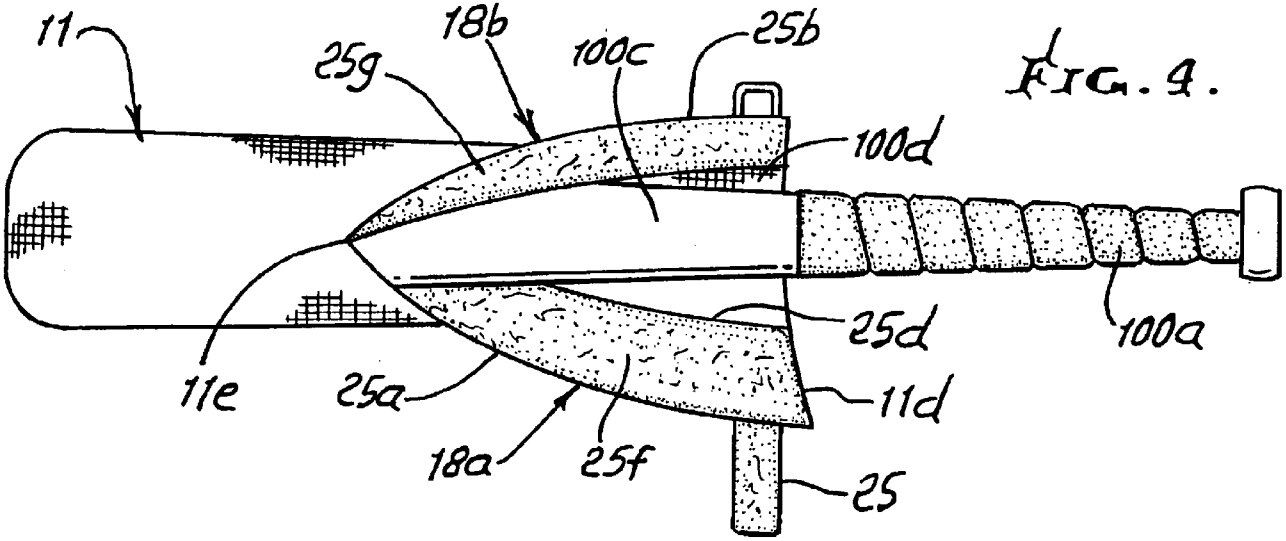
FIG. 4 is a view like FIG. 1, but showing use of hook and pile fastening material in association with a flap and a surface of the receptacle.
Figure 5:
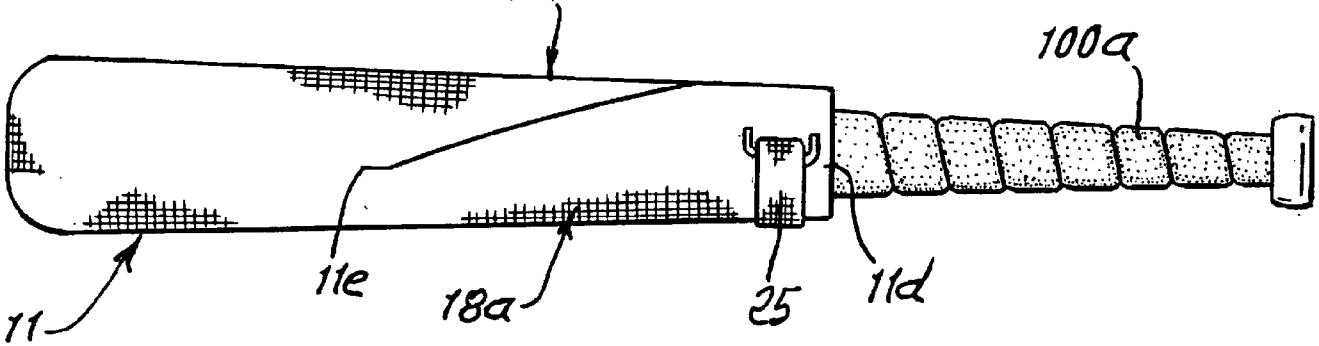
FIG. 5 is a view like FIG. 4 after the flap is closed.

In the example, a retainer in the form of a strap 25 is shown in open position in FIGS. 1 and 4; and in closed position FIG. 5. The strap is or may be integral with the proximal end wall portion 11*d* of the receptacle. The receptacle extents 18*a* and 18*b* turned open in FIG. 4, define a flap or flaps, that have forward and rearward angled edges 25*a* and 25*b*, convergent and intersecting at 11*e*. When flap 18*a* is folded at fold zone 25*d*, edge 25*a* folds over edge 25*b* and over the side 100*c* of the received bat, in close fitting relation. The flap 25*a* inner surface 25*f* may be retained to outer surface 25*g* of flap 18*b*, as by hook and pile attachment, after spiral winding of one flap over the other, enabling easy opening and closing of the flap 18*a* and its adjustable firm closing of the described enlarged opening 102, as well as tightening to closely fit the receptacle to the bat ball striking portion, while at the same time providing very firm attachment of the device to the bat, preventing loosening and/or detachment, as during club swinging. See FIG. 5. Strap 25 may be wound about the closed flaps, at the proximal end of the receptacle, to effect at least part closing of proximal end opening 102, and VELCRO on the strap surfaces holds it closed. Hook and pile structure preferable extends over a wide inner extent of folded back flap 18*a*, and a wide outer extent of flap 18*b*, as shown, so that the flap 18*a* can be adjustably attached in selected positions (tightened and loosened), considering the different cross sectional sizes of different bats to be protectively confined. Therefore, versatility of the device is enhanced. The majority of opening 102 is covered by the flap, as in FIG. 5. The closed flaps have taper toward handle 100*a*, as seen in FIG. 5, due to bat shank taper, locking the receptacle to the bat against endwise separation as during practice swinging.

Further in accordance with the invention, weighting structure is carried by the receptacle to add substantial weight to the head weight, for use in bat swinging; and it is typically carried by a receptacle inner sleeve 40 that fits endwise into receptacle outer sleeve 41. See FIGS. 2 and 3.

The weighting structure is so carried that it is located at or proximate one of the following:

vi) at least one of such wall portions on at least one sleeve;

vii) at least two of such wall portions on at least one sleeve;

viii) at least three of such wall portions, on at least one sleeve.

Figure 2:
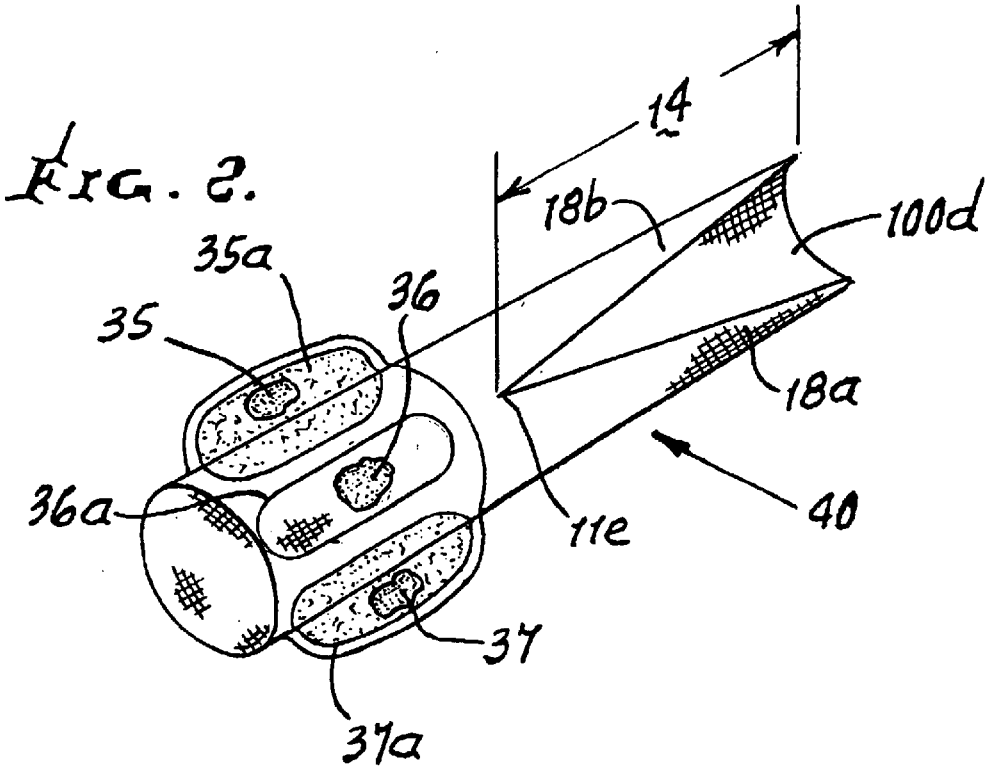
FIG. 2 is a perspective view showing a receptacle inner sleeve, carrying weighting material.
Figure 3:
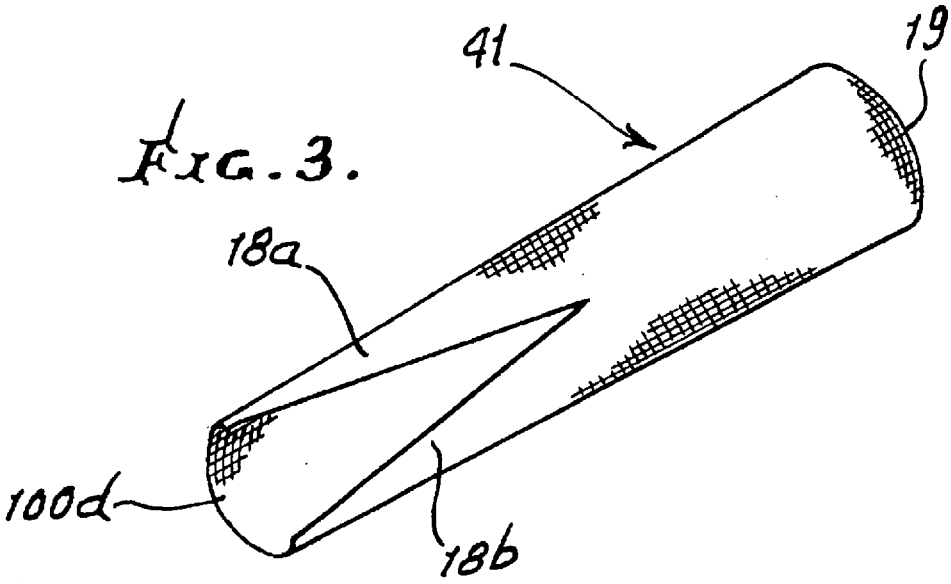
FIG. 3 is a perspective view of a receptacle outer sleeve.

In FIG. 2, the weighting structure includes three metallic (steel particles for example) weights 35–37 located in pockets 35*a*–37*a* at or near the distal end of sleeve 40. Such pockets may be formed by receptacle or sleeve material. The thickness of each weight is typically less than its length and less than its width, as shown. The pockets may be closed to hold the weights in positions, as described. The weights are retained in selected position or positions as by the sleeve or sleeves as shown, and the pockets may be selectively attached (for example sewn) to sleeve wall fabric, as by hook and pile elements, or other structure. The pockets can be adjustably or permanently attached to sleeve 40.

Weight material may alternatively consist of metallic granules, or non-metallic pebbles or particulates.

Figure 6:
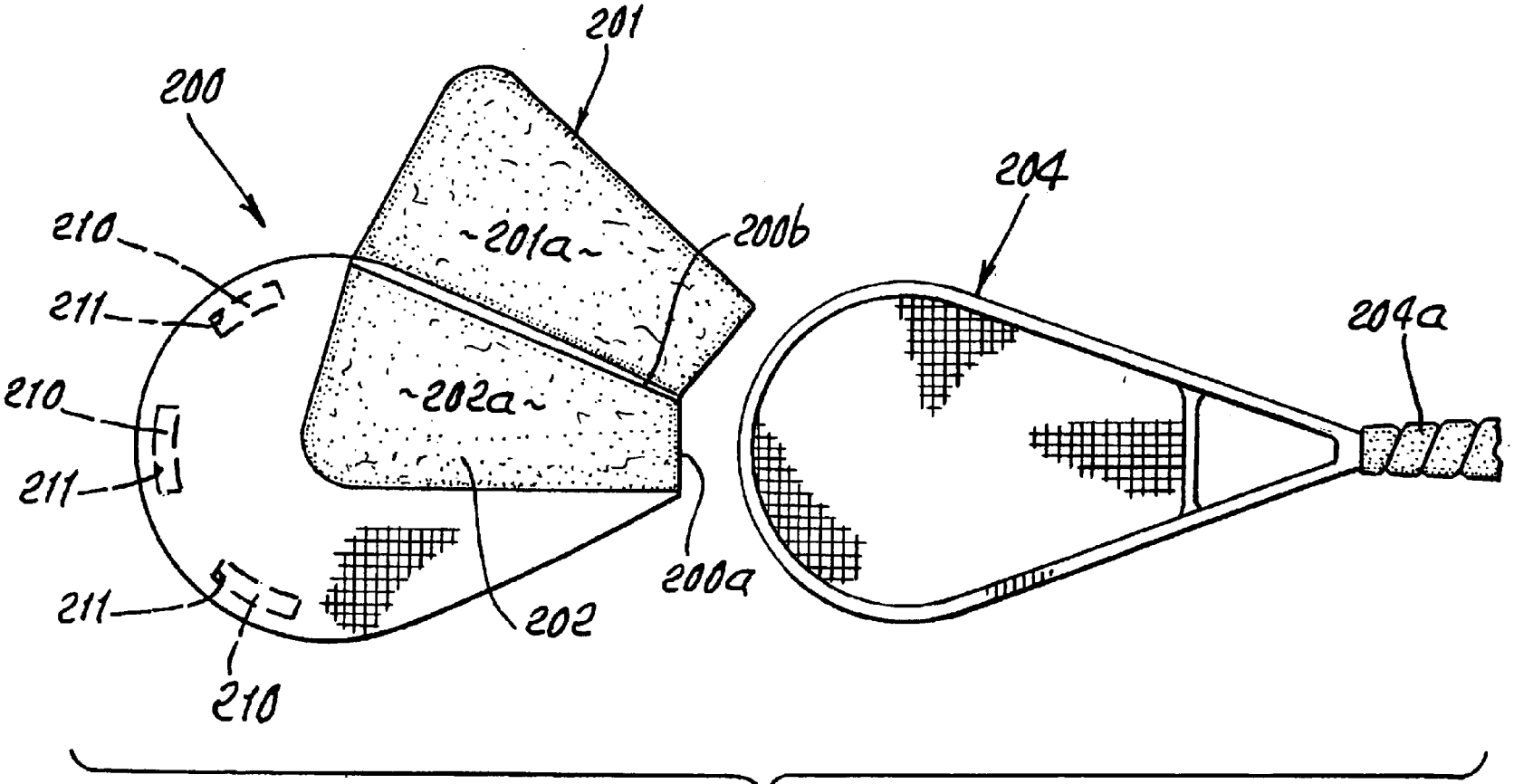
FIG. 6 is a view like FIG. 1 but showing a receptacle and retainer for a tennis racket, in unwrapped, open position.
Figure 7:
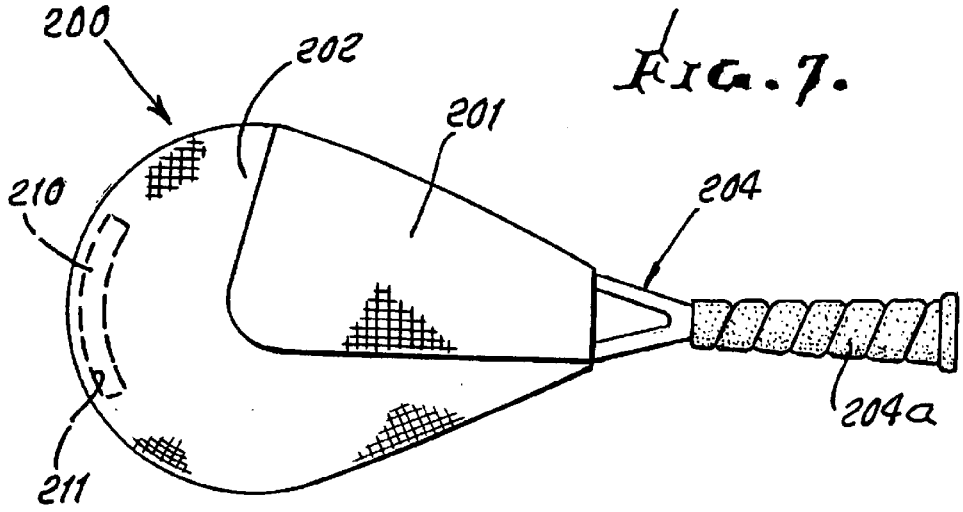
FIG. 7 is a view like FIG. 6 showing the retainer in closed position.
Figure 8:
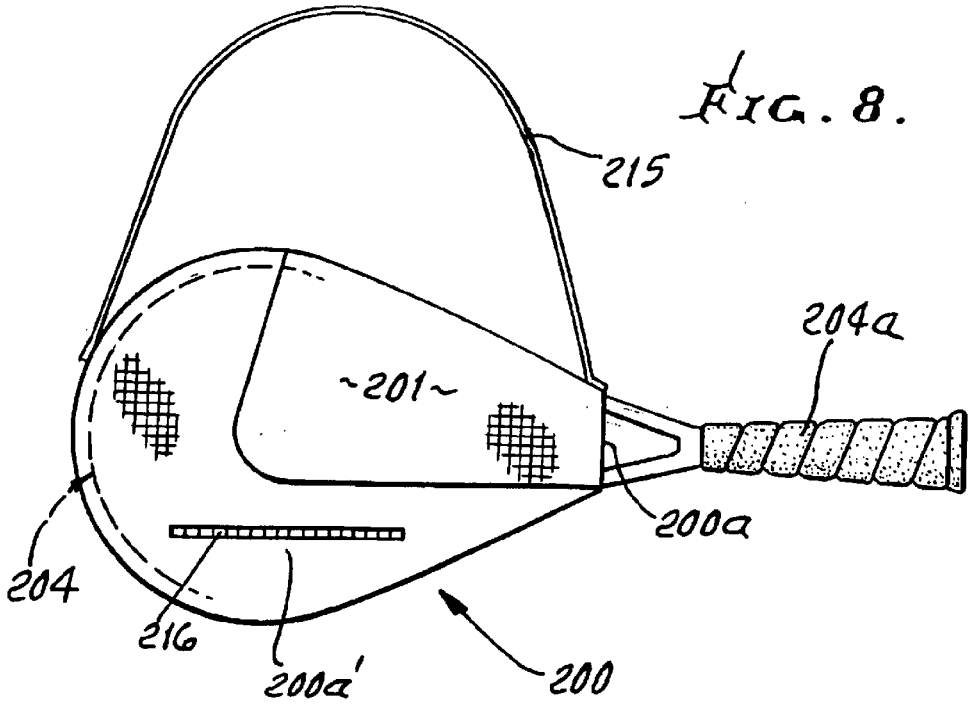
FIG. 8 is a view like FIG. 7 showing a carrier attached to the receptacle.

FIGS. 6–8 show a receptacle 200 shaped like a tennis racket ball striking head portion 204 (tear drop shape periphery), and having a flap 201 to close over a side 202 of the receptacle and retain the head in position. See flap VELCRO at 201*a* and VELCRO 202*a* on 202. Handle 204*a* projects from the receptacle end opening 200*a* in FIG. 7. The latter intersects a side opening 200*b* to form an enlarged opening through which head portion 204 is placed or received. Weights 210 are carried in pockets 211 in or on the receptacle. When the flap 201 is closed, the head portion 204 is trapped in the receptacle to prevent separation during practice swinging. A carrier loop is provided at 215; and a zipper at 216 on receptacle side 200*a*′.

In all forms, any number of more weight can be used.

In all forms the retainer can incorporate a buckle or buckles for tightening purposes.

Figure 9:
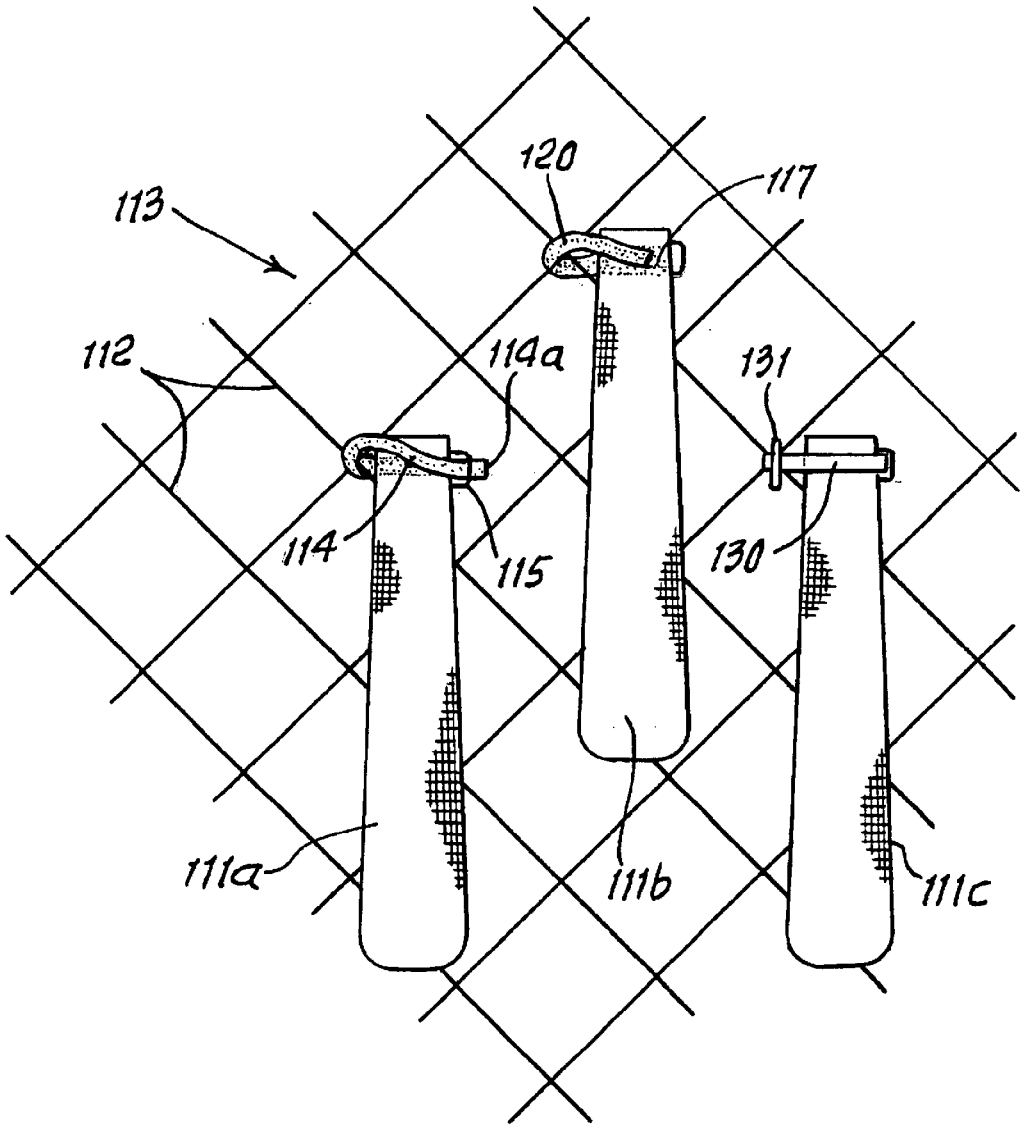
FIG. 9 shows bat receptacle suspension modes.

FIG. 9 shows three receptacles 111*a*, 111*b* and 111*c* suspended by support structure, as for example the mesh wires 112 of a fence 113. Each receptacle may be of the type described above, as at 11, i.e. for reception of a baseball bat, or other device having a handle. Receptacle 111*a* has a strap 114 attached at 115 to the bat receiving proximal end of the receptacle; and strap 114 has a free end portion 114*a* to be tightly wrapped about the receptacle end, after passing through the wire mesh 112; and the strap end portion then passes through a loop 115 attached to the receptacle. Hook and pile structure may be provided on the strap and receptacle to hold the strap in tightened condition.

Receptacle 111*b* has a strap 120 fastened at one end to the receptacle. The strap passes through the mesh 112, and then loops back on itself to be held in position by VELCRO, i.e. hook and pile material, at 117.

Receptacle 111*c* has a strap 130 fastened at one end to the receptacle and then wrapped tightly about the handle of the bat and held in position. A clip 131 attached to the strap also releasably clips to the wire mesh 112, to hold the receptacle in hanging position. the wire mesh 112, to hold the receptacle in hanging position.

I claim:

1. A weighting device for use on an athletic ball striker as during swinging of the striker, the striker having an elongated ball striking portion and handle, comprising in combination:

a) an elongated receptacle having an opening via which the striker ball striking portion is received into the receptacle, with the handle projecting endwise from the receptacle, b) a retainer carried on the receptacle to be fastened in a position for retaining the receptacle in generally enclosing relation to the striker ball striking portion, c) and weighting structure carried by the receptacle to add substantial weight to the striker, for use as in striker practice swinging, d) said retainer including a flap that folds over and releasably attaches to a surface carried by the receptacle, to effect retention of the weighted receptacle to the striker during said practice swinging, e) and including said striker comprising a base ball bat, and the receptacle being generally tubular and closely fitting the bat, along substantially the entirety of the receptacle length, remotely from the handle; and the flap defined by a V-shaped slotted portion of the receptacle extending generally lengthwise of the receptacle at one side thereof.

2. The combination of claim 1 including hook and pile fastening material for fastening said retainer in said position.

3. The combination of claim 1 wherein said flap is elongated and extended at least part way about the receptacle.

4. The combination of claim 2 wherein said flap is elongated and extended at least part way about the receptacle.

5. The combination of claim 1 wherein said retainer at least partly covers said opening in said fastened position.

6. The combination of claim 3 wherein said flap at least partly covers said opening in said fastened position.

7. The combination of claim 1 wherein said receptacle has multiple walls and said weighting structure is located at or proximate at least one of said walls.

8. The combination of claim 7 wherein said weighting structure is located at or proximate one of the following:

a) at least one of said walls, b) at least two of said walls, c) at least three of said walls, d) at least four of said walls.

9. The combination of claim 1 wherein said weighting structure includes metal.

10. The combination of claim 9 wherein said metal is within said receptacle.

11. The combination of claim 8 wherein said weighting structure includes separate local metallic portions.

12. The combination of claim 9 wherein said metal is held in a pocket or pockets provided by the receptacle.

13. The combination of claim 1 wherein the receptacle includes an inner sleeve and an outer sleeve, the weighting structure retained to the inner sleeve, said opening formed by a sleeve wall slot and by an end opening at a proximal end of said outer sleeve.

14. The combination of claim 1 wherein said weighting structure is sized and retained proximate at least one of the following portions of a striker ball striking portion received in the receptacle:

i) front side portion ii) rear side portion iii) toe portion.

15. The combination of claim 1 including a carrier attached to the receptacle at spaced locations.

16. The combination of claim 8 wherein the weighted structure includes metal.

17. The combination of claim 1 including a strap attached to the receptacle, and adapted to be wrapped about the handle, or other support structure.

18. The combination of claim 17 including a loop which is attached to the receptacle or strap, to receive a free end portion of the strap.

19. The combination of claim 17 including said support structure which has mesh configuration, and from which the strap hangs, suspending the receptacle.

20. The combination of claim 17 including a clip attached to the strap or receptacle, and including supporting structure which has mesh configuration, the clip attached to said mesh configuration.

21. A weighting device for use on an athletic ball striker as during swinging of the striker, and including the striker having a ball striking portion and handle, comprising in combination:

a) an elongated receptacle having an opening via which the striker ball striking portion is received into the receptacle, with the handle projecting from the receptacle, b) a retainer flap carried on the receptacle adjacent an elongated V-shaped receptacle slot, for retaining the receptacle in generally enclosing relation to the striker, d) there being weight material disposed at annular locations about an axis defined by the striker, and structure disposed about the striker holding said weight material in position relative to the striker, said structure including pockets spaced about the striker and in which said weight material is held at said annularly spaced locations.

* * * * *